US011603674B1

(12) United States Patent
Kubie

(10) Patent No.: US 11,603,674 B1
(45) Date of Patent: Mar. 14, 2023

(54) WALER SYSTEM

(71) Applicant: PERI Formwork Systems, Inc., Elkridge, MD (US)

(72) Inventor: Brittny Kubie, Groveland, FL (US)

(73) Assignee: PERI Formwork Systems, Inc., Elkridge, MD (US)

( * ) Notice: Subject to any disclaimer, the term of this patent is extended or adjusted under 35 U.S.C. 154(b) by 233 days.

(21) Appl. No.: 16/824,690

(22) Filed: Mar. 19, 2020

(51) Int. Cl.
*E04G 11/54* (2006.01)

(52) U.S. Cl.
CPC ..... *E04G 11/54* (2013.01)

(58) Field of Classification Search
CPC ..... E04G 11/50; E04G 11/54; E04G 17/002; E04G 17/14; E04G 25/061
See application file for complete search history.

(56) References Cited

U.S. PATENT DOCUMENTS 2,671,697 A * 3/1954 North ..... E04G 11/48 425/62
4,003,541 A * 1/1977 Lanier ..... E04G 11/38 425/62
4,074,499 A 2/1978 Mess
4,084,780 A 4/1978 Mess
6,089,779 A 7/2000 Lancelot, III
7,487,949 B2 2/2009 Bennett
8,042,786 B2 10/2011 Spindler
9,347,231 B2 5/2016 Cormier
2006/0059841 A1 3/2006 Bennett
2008/0307727 A1 12/2008 Magee
2016/0001759 A1 1/2016 Clark
2016/0017593 A1 1/2016 Magee
2018/0080238 A1* 3/2018 Lenkin ..... E04B 5/02
2018/0106055 A1* 4/2018 Chevis ..... E04G 17/002
2018/0340342 A1* 11/2018 Lizarazu Zaldua ... E04G 17/002

FOREIGN PATENT DOCUMENTS

FR 2620479 A1 * 3/1989
GB 778393 A * 7/1957

* cited by examiner

*Primary Examiner* — Christine T Cajilig
(74) *Attorney, Agent, or Firm* — Wei & Sleman LLP

(57) ABSTRACT

A waler assembly with an integrated castor attachment point that eliminates the need hinge or fold a leg during assembly/disassembly. A vertical tube assembly having an increased load allowing for greater flexibility on job sites.

17 Claims, 10 Drawing Sheets

WALER SYSTEM

FIELD OF THE INVENTION

The present application relates to a waler for use in construction.

BACKGROUND OF THE INVENTION

In construction of certain concrete structures, such as parking decks, it is useful to use a beam table, waler, and prop assemblies to support slab tables for laying a concrete floor and/or columns. In particular, in the assembly sequence, beam tables can be installed between columns of the structure and props extending downwardly from walers can be supported by a level beneath. Once beam tables are assembled, slab tables can be laid atop and a subsequent level of the concrete structure can be laid.

Once the subsequent level is completed, the waler and prop assemblies can be dissembled (e.g., stripped) from the structure. This includes hinging legs on the waler assembly to allow for installation of castor assemblies. In doing so, the legs can be secured in place by one or more pins with respect to the beam table. The beam table can be removed from the slab and the waler can be lowered to the lower level and moved by way of the castor wheels to another location. This process can be repeated for subsequent levels.

Certain existing waler assemblies use a secondary castor attachment that fixed to the waler by a friction connection. This implementation, however, has certain disadvantages in that the assembly point (e.g., a hole) between the waler and the castor interfered with other components of the assembly, thus necessitating the hinging or folding of the leg before installation of the castor wheel. This is counterintuitive to the site operations.

Further, existing vertical tube designs were limited in their allowable load due to the sizing of the pipe structural capacity.

SUMMARY OF THE INVENTION

The present application overcomes the disadvantages of the prior art by providing a waler assembly with an integrated castor attachment point that eliminates the need hinge or fold a leg during assembly/disassembly. The present application also provides a vertical tube assembly having an increased load allowing for greater flexibility on job sites.

BRIEF DESCRIPTION OF THE DRAWINGS

The detailed description below refers to the accompanying drawings, of which.

DETAILED DESCRIPTION

Figure 1A:
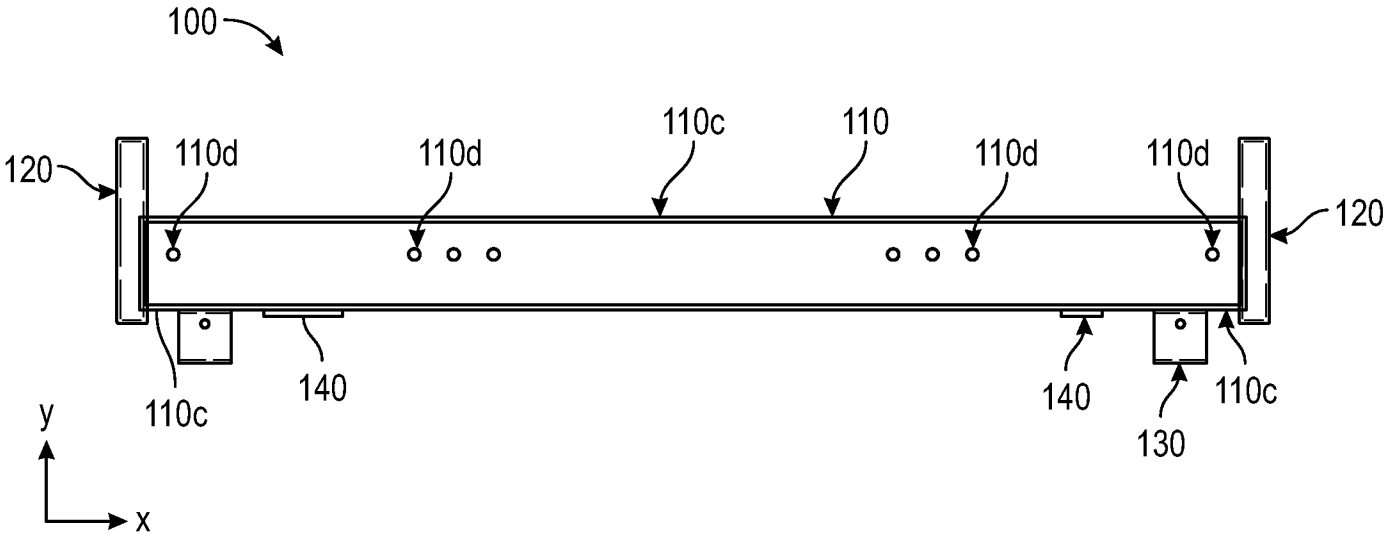
FIG. 1A is side view of a waler according to one or more aspects of the disclosure.
Figure 1B:
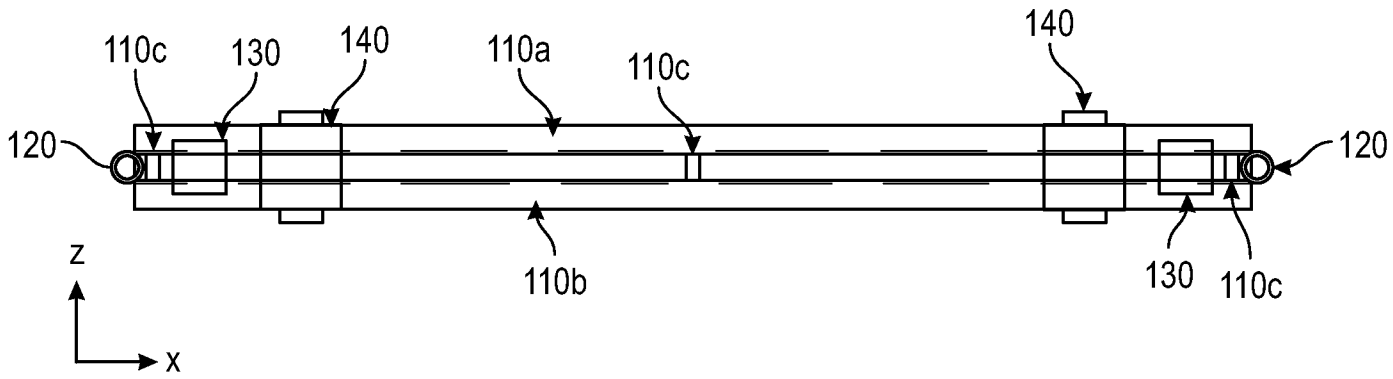
FIG. 1B is a top view of the waler of FIG. 1A according to one or more aspects of the disclosure.
Figure 1C:
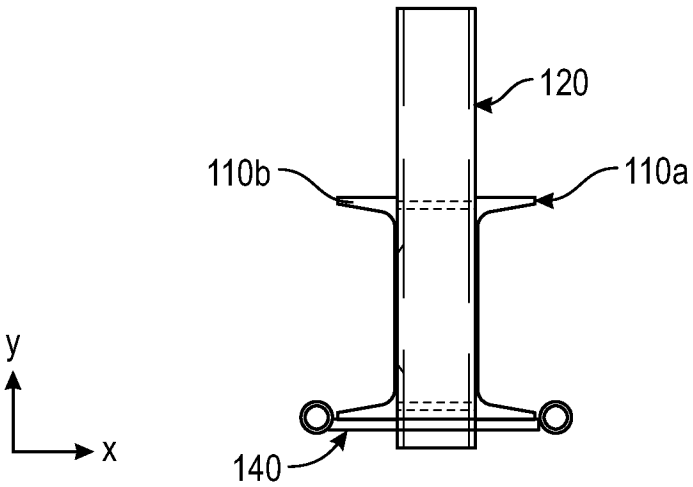
FIG. 1C is an edge view of the waler of FIGS. 1A-B according to one or more aspects of the disclosure.

FIGS. 1A-C are side, top, and edge views, respectively, of a waler 100 according to one or more aspects of the disclosure.

As shown, the waler 100 can include a beam 110, one or more vertical support tubes 120, one or more castor attachment interfaces 130 and one or more hinge plates 140.

A 3D (x,y,z) coordinate system is depicted herein, which should be taken only as a reference to relative directions and not an as an absolute indication of spatial orientation. Such depiction can define space in a variety of ways, including Cartesian coordinates (as shown, polar coordinates, and the like.

The beam 110 can be one or more structural channels (e.g., a double C-channel configuration interconnected by one or more tabs 110*c*) and can be in the range of 6 to 8 feet (approximately 1.82 to 2.43 m) in length generally along the x direction (excluding support tubes 120) and can be 6 to 8 inches (approximately 15.24 to 20.32 cm) in height generally along the y direction (excluding support tubes 120). In one particular example, the beam 110 can be about 7 feet (approximately 2.1336 m) in length generally along the x direction (excluding support tubes 120) and can be about 7 inches (17.78 cm) in height generally along the y direction (excluding support tubes 120).

A width of the beam 110 can be defined from flange to flange and can be in the range of 6 to 7 inches (approximately 15.24 to 17.78 cm) generally along the z direction, with a longitudinal channel of width of 2 to 3 inches (approximately 5.08 to 7.62 cm) being defined between the flange portions 110*a, b* generally along the z direction. In one particular example, the width of the beam 110 can be defined from flange to flange and can be about 6 and 7/16 inches (approximately 16.35 cm) generally along the z direction, with a longitudinal channel of width of 2 and 3/16 inches (approximately 5.56 cm) being defined between the flange portions 110*a, b* generally along the z direction.

The beam 110 can be formed of steel, aluminum, alloy, or any material. In one particular example, the beam 110 and the flange portions 110*a, b* can be formed of ASTM A36 steel. The flanges 110*a, b* of the beam 110 can be interconnected by tabs 110*c*, which can also be formed of ASTM A36 steel. The A36 standard, established by ASTM International, is defined as a density of 7,800 kg/m$^3$ (0.28 lb/cu in), a Young's modulus of 200 GPa (29,000,000 psi), a Poisson's ratio of 0.26, and a shear modulus of 78 GPa (11,300,000 psi).

The flanges 110*a, b* can each define a respective plurality of holes 110*d* configure to allow attachment of other components during the construction process.

The beam 110 can be integrally interconnected with one or more vertical tubes 120 extending generally in the y direction. The one or more tubes 120 are arranged at longitudinal ends of the beam 110. The one or more tubes 120 can be welded directly to each of the flange portions 110*a, b* of the beam 110. The one or more support tubes 120 extend vertically with respect to the longitudinal beam 110 and extends both above and below the flanges.

With reference to FIG. 1C, the vertical support tube 120 can have a height generally along the y direction of about 14 inches (approximately 35.56 cm) and can be cylindrical with a hollow core. A diameter of the cylindrical shape can be in the range of 2 to 3 inches (approximately 5.08 to 7.62 cm). In one example, the diameter can be about 2 and ⅜ inches (approximately 6.03 cm). In one example, the vertical support tube can extend in the range of 5 to 7 inches (approximately 12.7 to 17.78 cm) above a top surface of the flanges 110*a, b* of the beam 110. In one particular example, the vertical support tube can extend about 6 inches (approximately 15.24 cm) above the top surface of the flanges 110*a, b* of the beam 110. Given a flange 110*a, b* height of about 7 inches (approximately 17.78 cm), the vertical support tube can extend below the flanges 110*a, b* by about 1 inch (approximately 2.54 cm). In this regard, a ratio of length of the beam 110 to a height of vertical support tubes 120 can be about 12:1.

The vertical support tubes can be formed of a steel having a different grade or strength a portion or an entirety of the remainder of the waler. For example, the vertical support tubes can be formed of a stronger grade steel than a portion or an entirety of the remainder of the waler. The vertical support tubes can be formed of ASTM A500 steel with a grade of at least, equal to, or approximately 46 ksi. The A500 standard, defined by ASTM International, can comprise grades A, B, C, and D, defining tensile strengths of 45 ksi, 58 ksi, 62 ksi, or 58 ksi respectively, yield (round) strength of 33 ksi, 42 ksi, 46 ksi, and 36 ksi respectively, yield (shaped) strength of 39 ksi, 46 ksi, 50 ksi, and 36 ksi, respectively. The vertical tubes can include one or more of the grades A, B, C, or D. In this regard, the vertical support tubes can be made of a different strength of material (e.g. steel) than the beam 110 and the attachment interfaces 130, and in one particular example can be formed of steel having a greater strength and/or grade than the beam 110 and the attachment interfaces 130. In one example, the vertical support tubes 120 can support up to 70 kN of load (e.g. concrete load) without sustaining buckling of the waler or vertical tube. In this regard, the waler 100 can accommodate greater than or equal to the concrete load of prior systems with a reduced vertical tube height and using a same or similar spindle arrangement.

The waler 100 can include one or more castor attachments interfaces 130. The castor attachment interfaces can be arranged below the beam 110 and flanges 110*a, b*. The castor attachment interfaces define one or more castor holes 130*a* configured to receive a pin for removably attaching a castor wheel. The castor attachment interfaces 130 can be formed of ASTM A36 steel or ASTM A500 steel Grade B.

The one or more castor attachments interfaces 130 can be welded integrally with respect to beam 110. In another example, the one or more castor attachments interfaces 130 can be extruded.

The waler 100 can be configured to receive one or more hinge plates 140 for assembly with shoring (depicted and described below with respect to FIGS. 5-11). The shoring can have one or more vertically adjustable legs for accommodating variable height working environments. The hinge plates 140 can be formed of ASTM A36 steel.

Figure 2:
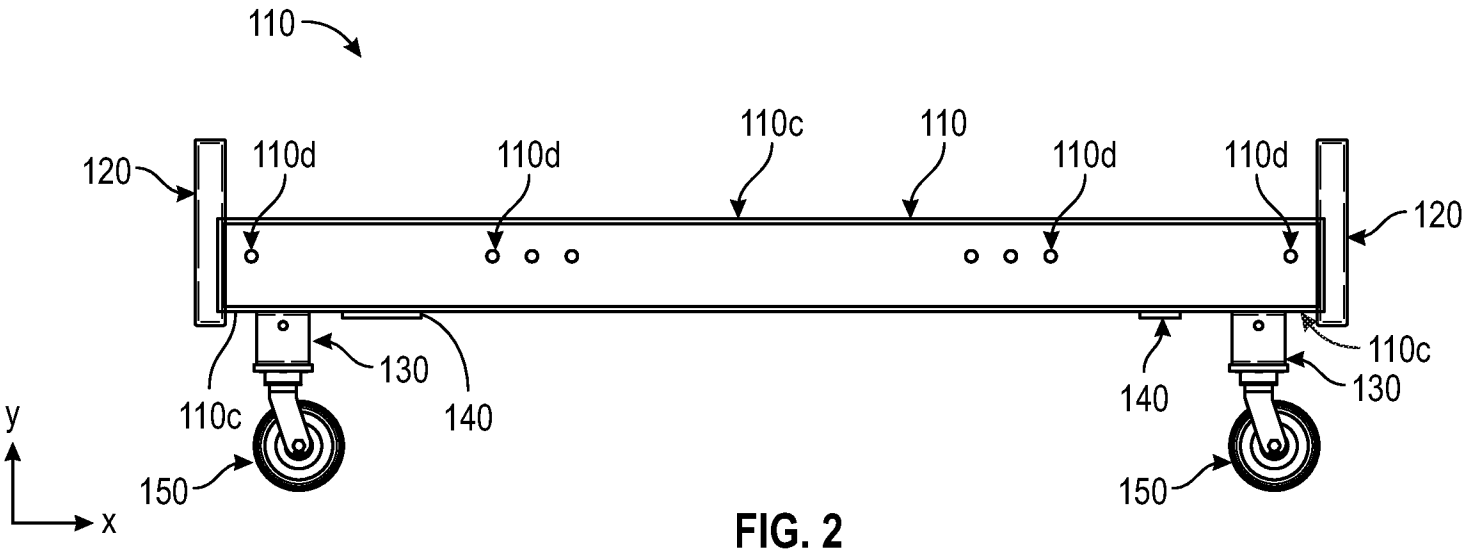
FIG. 2 is a side view of a waler with attached castor wheels according to one or more aspects of the disclosure.

FIG. 2 depicts a waler 100 with attached castor wheels 150. As shown, the castor wheels 150 are attached to the integral castor attachment interfaces 130. The castor wheels 150 can be attached by inserting the castor wheel 150 into a channel 130*b* of castor attachment interface 130 and inserting a pin into the hole 130*a*. In other examples, the castor wheels 150 can be permanently (e.g., welded); semi-permanently; or freely removably attached to the interfaces 130. To remove the castor wheel, the pin 160 can be removed from the interface 130 and the wheel can be removed from the interface 130.

Figure 3A:
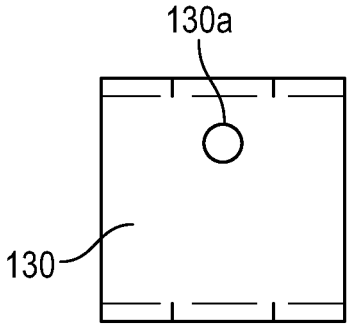
FIGS. 3A-B are side and top views of a castor attachment interface according to one or more aspects of the disclosure.
Figure 3B:
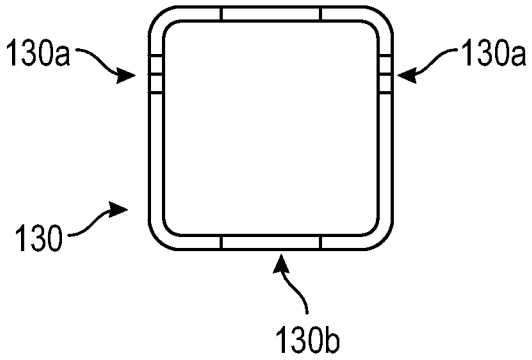

FIG. 3A-B show side and top views of an exemplary castor attachment interface 130. As shown, the castor attachment interface 130 defines a hole 130*a* on at least one side thereof. In one example, the interface 130 defines a pair of holes 130*a* on opposing faces thereof for receiving a pin completely therethrough. The pin can secure a castor wheel.

Figure 4:
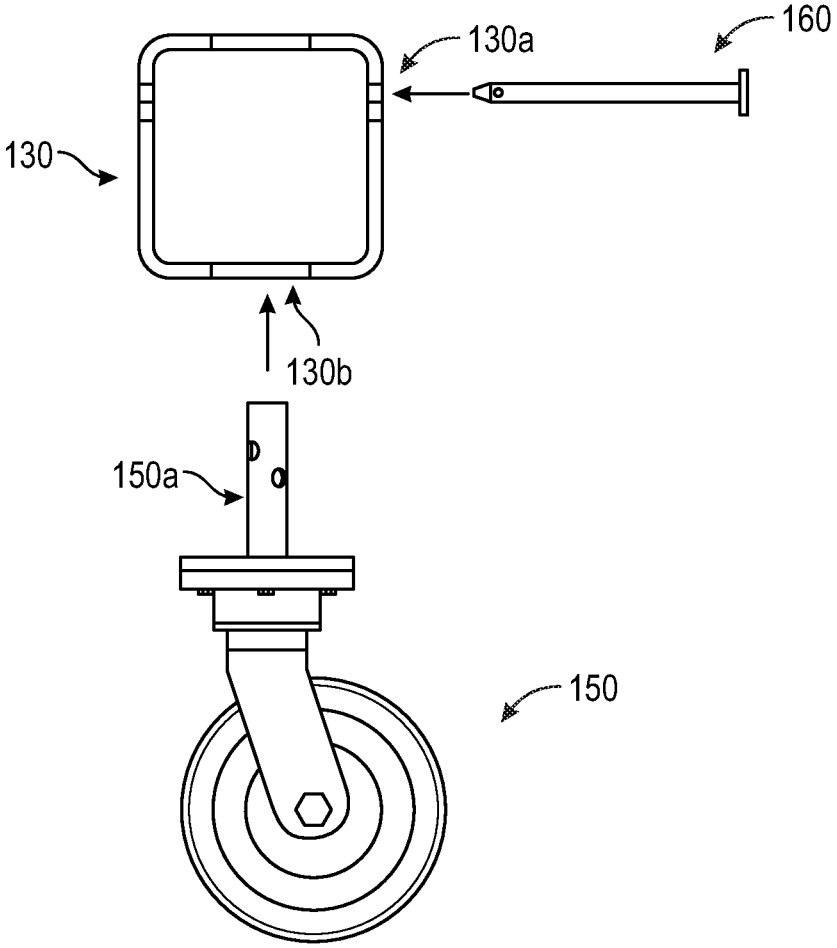
FIG. 4 is an edge view of an attachment interface being engaged with a castor wheel.

FIG. 4 depicts an attachment interface 130 (rest of waler 100 not shown) being connected with a castor wheel 150. As shown, the castor wheel 150 is inserted vertically into the castor attachment 130 via channel 130*b*. Once a stem 150*a* of the castor wheel 150 is inside interface 130, a pin 160 is inserted through hole 130*a* to secure the castor wheel 150 with respect to interface 130 and ultimately waler 100.

FIGS. 5-11 depict various stages of assembly and/or disassembly (stripping) of one or more walers from a concrete slab according to one or more aspects of the disclosure.

Figure 5:
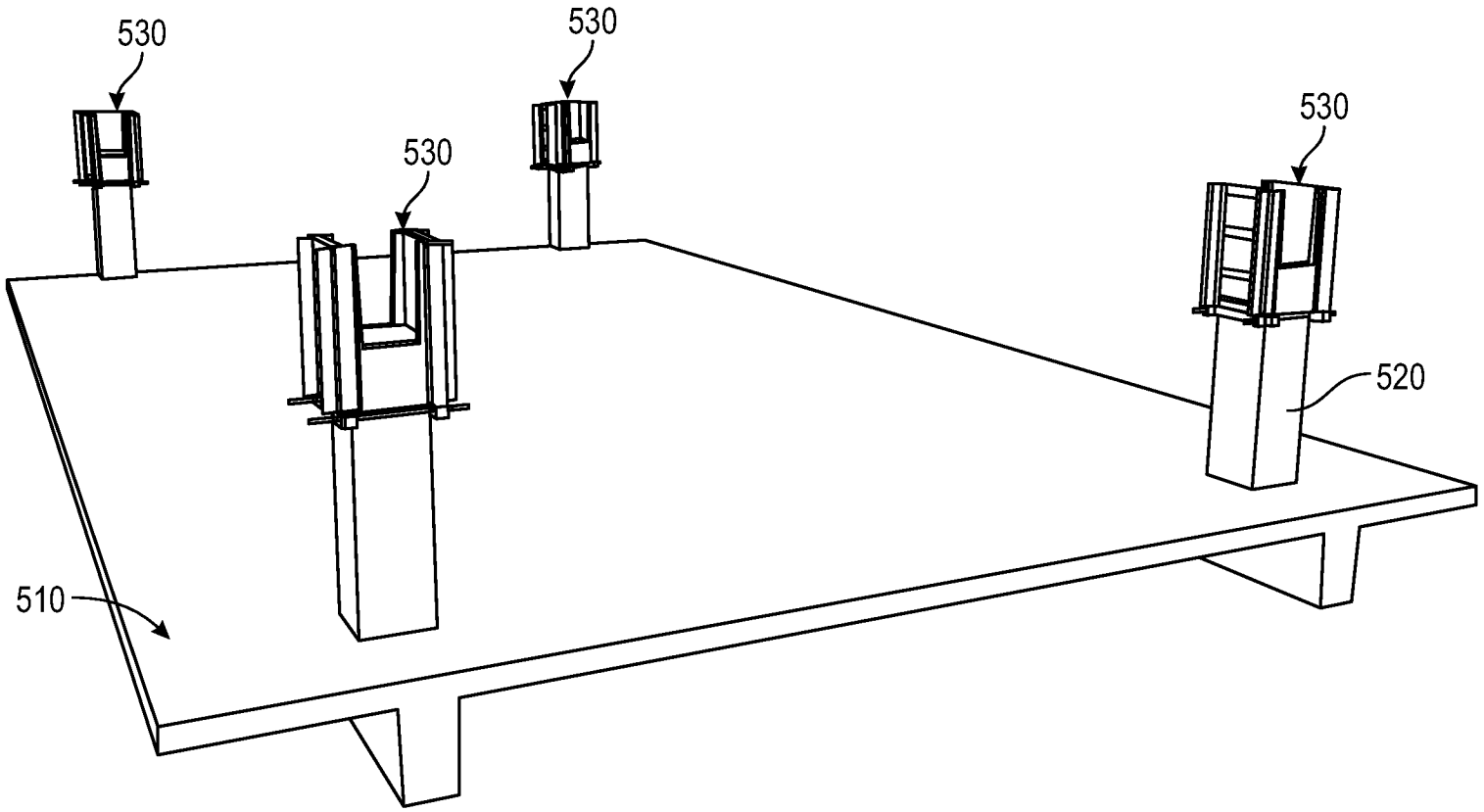
FIG. 5 depicts column capital assembly during a method of assembly and/or disassembly of one or more walers from a concrete slab.

With respect to FIG. 5, an existing concrete slab 510 is depicted with one or more columns 520 extending vertically therefrom. The slab 510 can be a level of a concrete structure, such as a parking garage. One or more column capitals 530 can be installed with respect to the columns 520. This can be accomplished by clamping lumber to the columns 520, arranging three sides of the column capital 530 with respect to the column 520, and arranging the fourth side of the column capital 530 with respect to the column 520.

Figure 6:
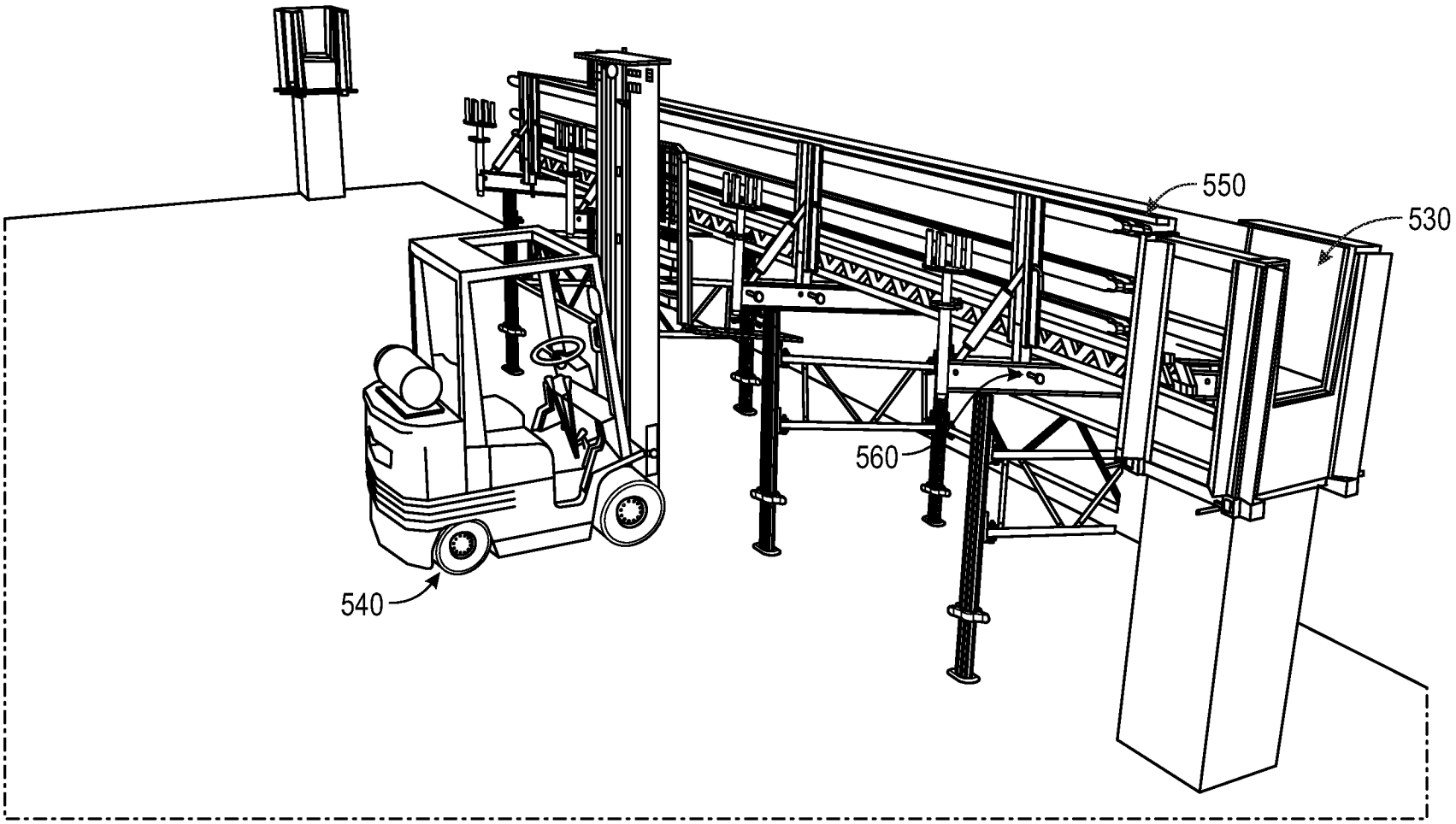
FIG. 6 depicts a forklift transporting and assembling a beam table, waler, and shoring during a method of assembly and/or disassembly of one or more walers from a concrete slab.

FIG. 6 depicts a forklift 540 transporting and assembling a beam table 550, waler 560, and shoring (e.g. props) 570 with respect to column capital 530. Waler 560 can be the exemplary waler 100 described above with respect to FIGS. 1-4. With respect to the shoring 570, the outside legs (e.g. those closest to columns 530) can be extended toward the slab 510 before interior legs. Optionally, one or more stringers can be mounted in a spindle with respect to vertical tubes of the waler 560. Additional beam tables, walers, and/or props can be installed with respect to additional columns as appropriate. The stringers can be extended past the column capitals 530 beyond the columns 520 and an additional girder can be installed spanning between the beam tables 550 with respect to the stringers. As depicted, the waler 560 can have castor wheels (e.g., castor wheels 150) attached thereto before, during, and after transporting and/or assembling.

Figure 7:
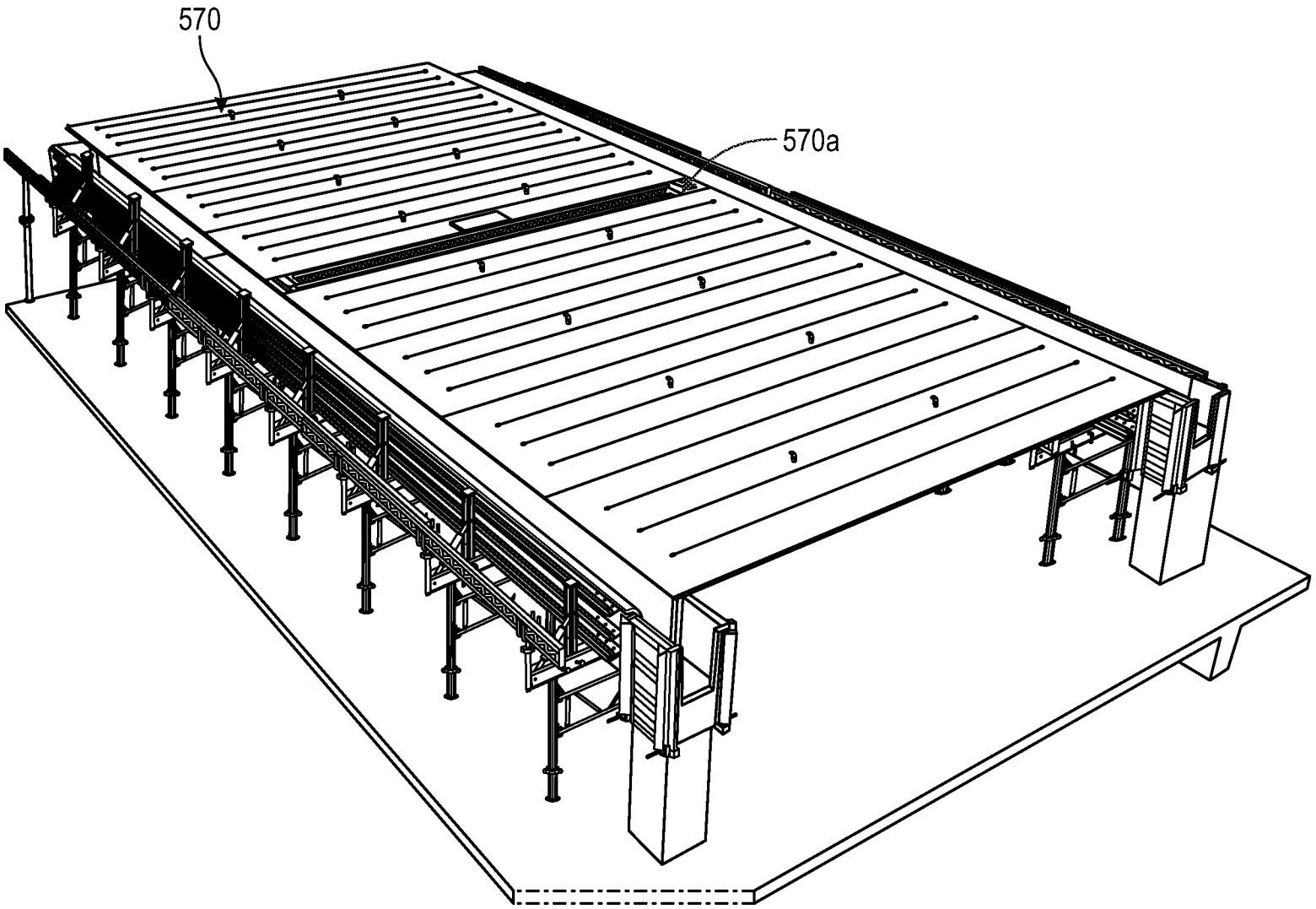
FIG. 7 depicts slab tables stacked on opposite ends of the beam tables to form a pouring surface for concrete during a method of assembly and/or disassembly of one or more walers from a concrete slab.

FIG. 7 depicts slab tables 570 stacked on opposite ends of the beam tables 550 to form a pouring surface for concrete. A gap 570*a* at the middle of the slab tables 570 can be closed with additional girders and/or plywood. Additional slabgrabbers, handrails, and/or slab edge boards can be installed with respect to the slab tables. Depending on width, additional center shoring 590 can be installed beneath the slab tables and arranged between longitudinally extending beam tables.

Figure 8:
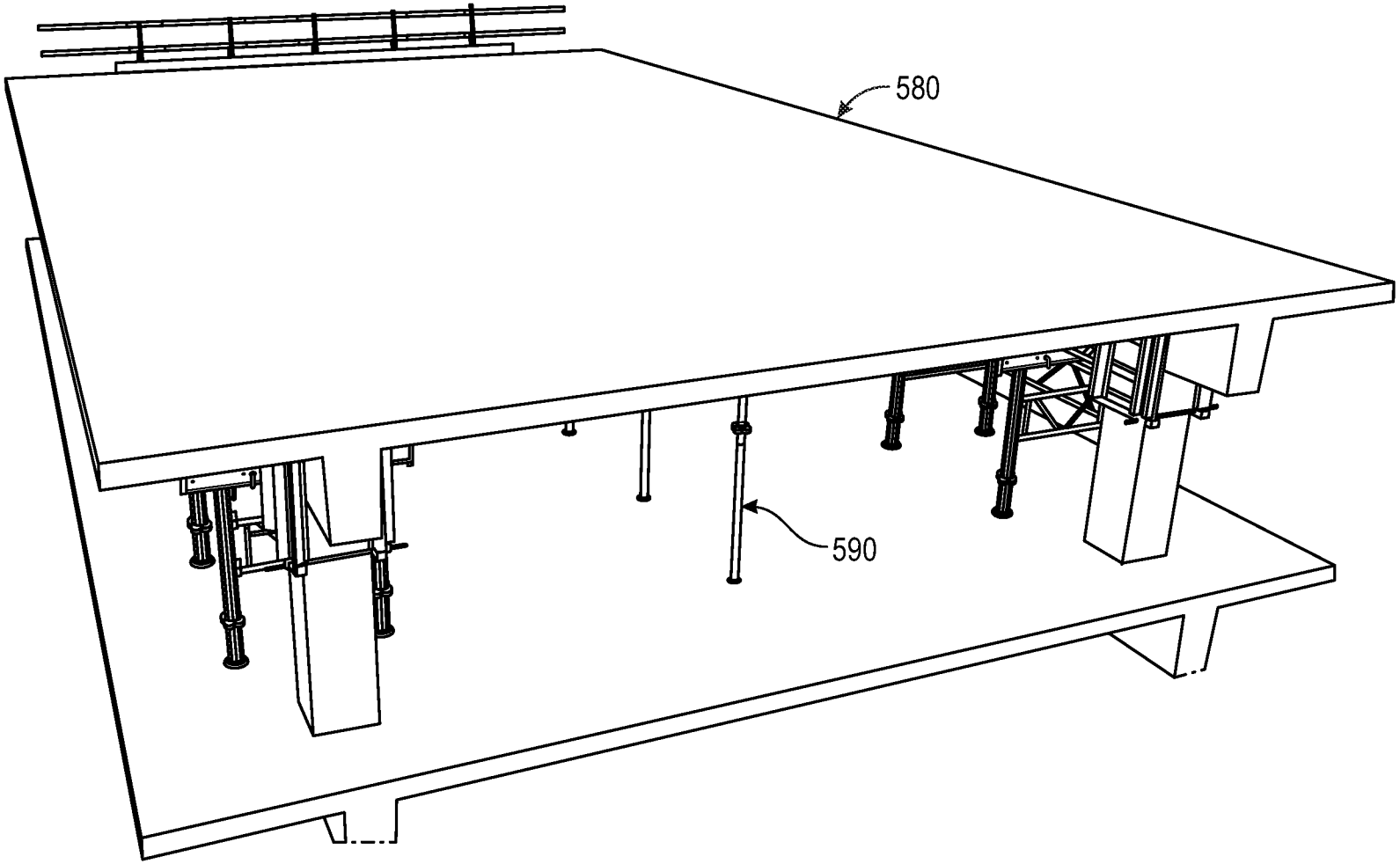
FIG. 8 depicts a concrete slab having been poured on the slab table during a method of assembly and/or disassembly of one or more walers from a concrete slab.

FIG. 8 depicts a concrete slab 580 having been poured on the slab table and within a channel defined by beam tables to form a level or floor of the concrete structure. As depicted, the waler 560 can have castors attached thereto before, during, and after pouring and drying of the concrete slab.

To begin disassembly (stripping), the handrails, slab edge, center shores, and/or column capitals can be removed. Further, certain frames interconnecting the shoring (e.g., extending longitudinally with respect to the beam tables) can be removed.

Figure 9:
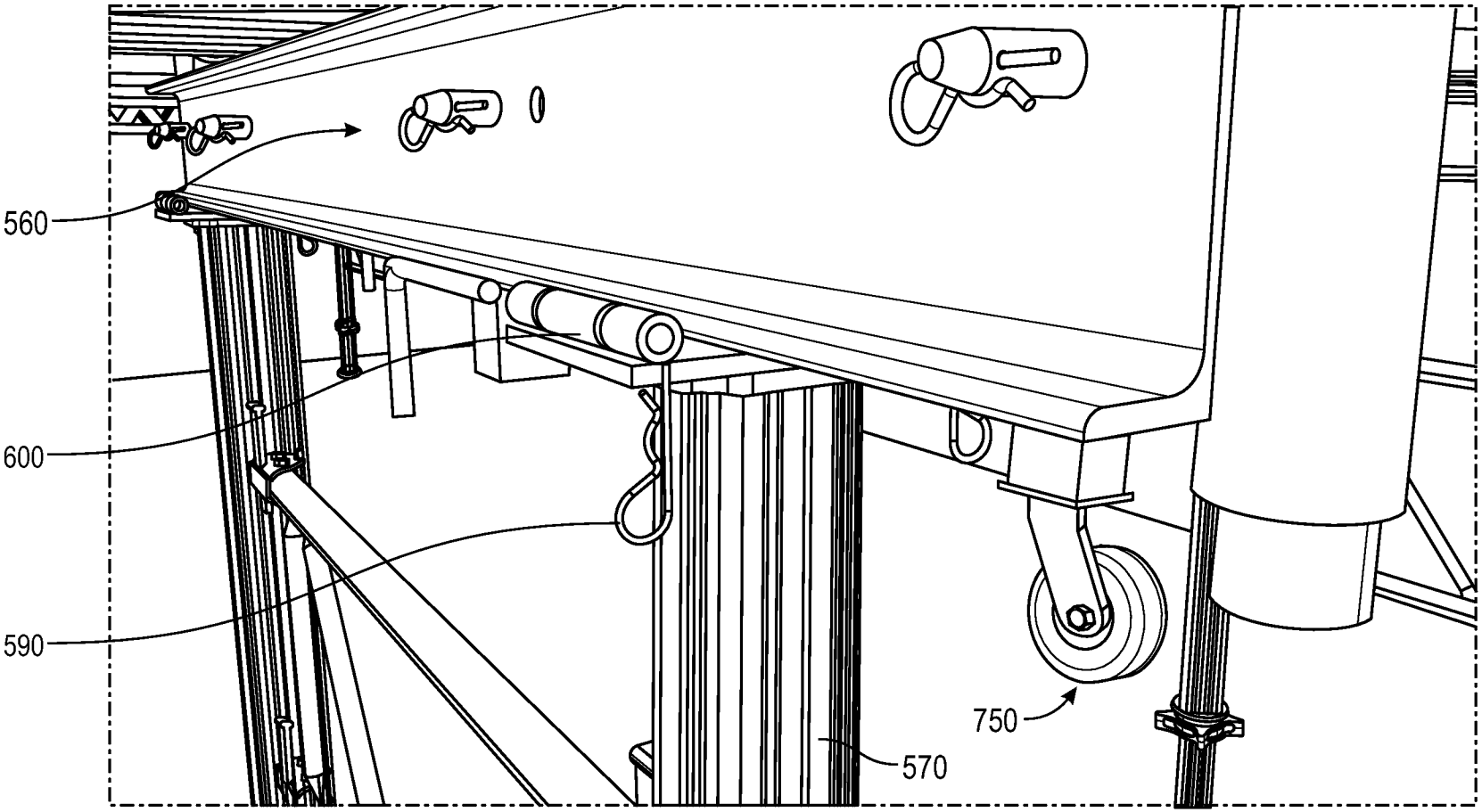
FIG. 9 depicts removal of a pin (e.g., cotter pin) from the hinge plate of the waler to prepare for folding of the shoring (props) during a method of assembly and/or disassembly of one or more walers from a concrete slab.

FIG. 9 depicts removal of a pin 590 (e.g., cotter pin) from the hinge plate 600 (e.g., hinge plate 140) of the waler 560 to prepare for folding of the shoring (props) 570. As depicted, the waler 560 can have castor wheels (e.g., 150) attached thereto before, during, and after removal of the pin and/or hinge plate. In one particular example, the castor wheels 150 can be installed at the interface at any state prior to the folding, either during assembly or disassembly, such as at any of the states described above with respect to FIGS. 5-8.

Figure 10:
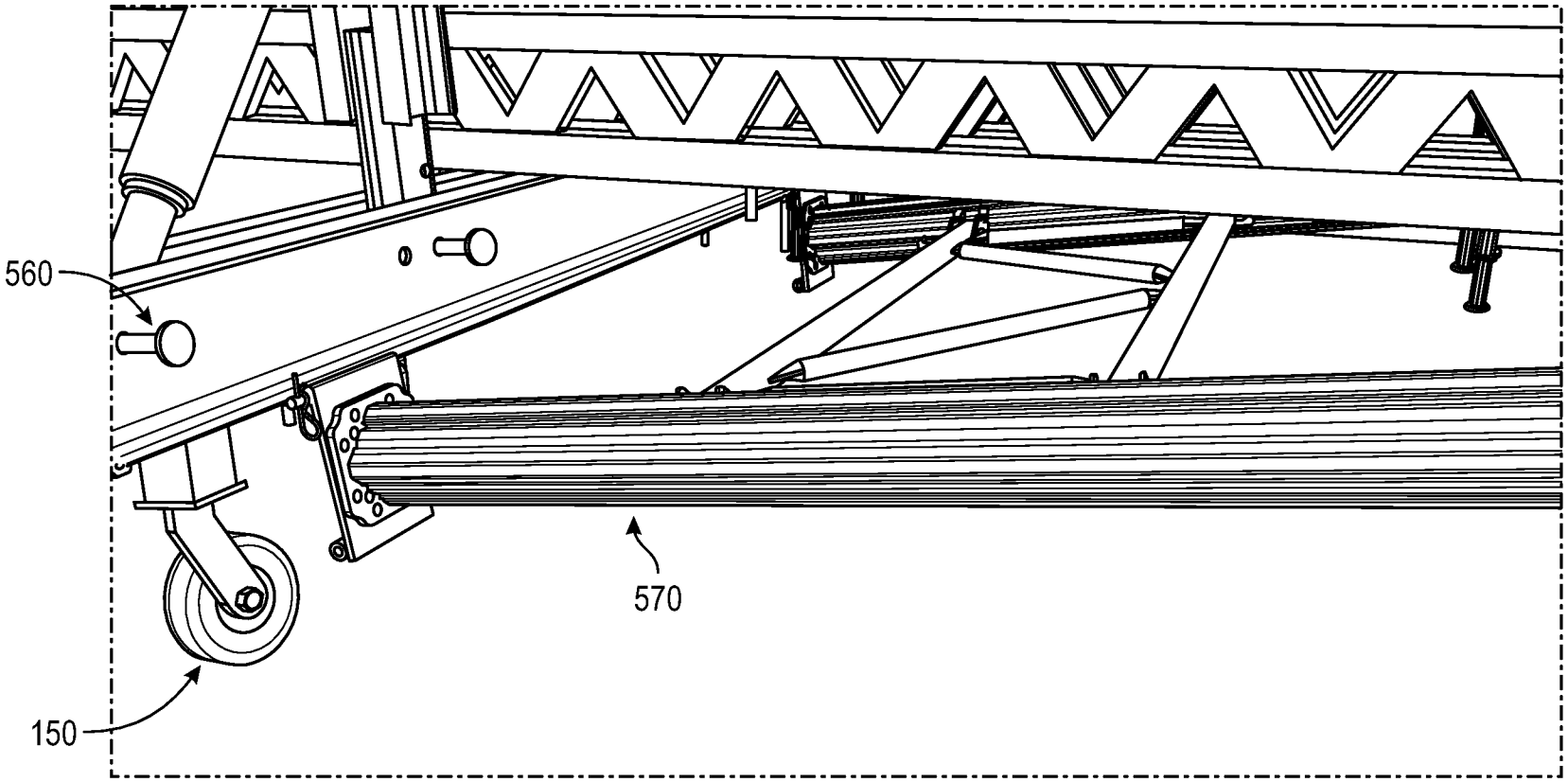
FIG. 10 a folded state of the shoring (props) during a method of assembly and/or disassembly of one or more walers from a concrete slab.

FIG. 10 depicts a folded state of the shoring (props) 570. As shown here, the castor wheels 150 remain engaged with the attachment interfaces (e.g., 130) of the waler 560 before, during, and after folding. Advantageously, this reduces the number of steps for workers on site and eliminates the need to remove and replace castor attachments and/or castor wheels among cycles of assembly, pouring, and disassembly. The folded legs can be secured to adjacent walers by a j-hook.

Figure 11:
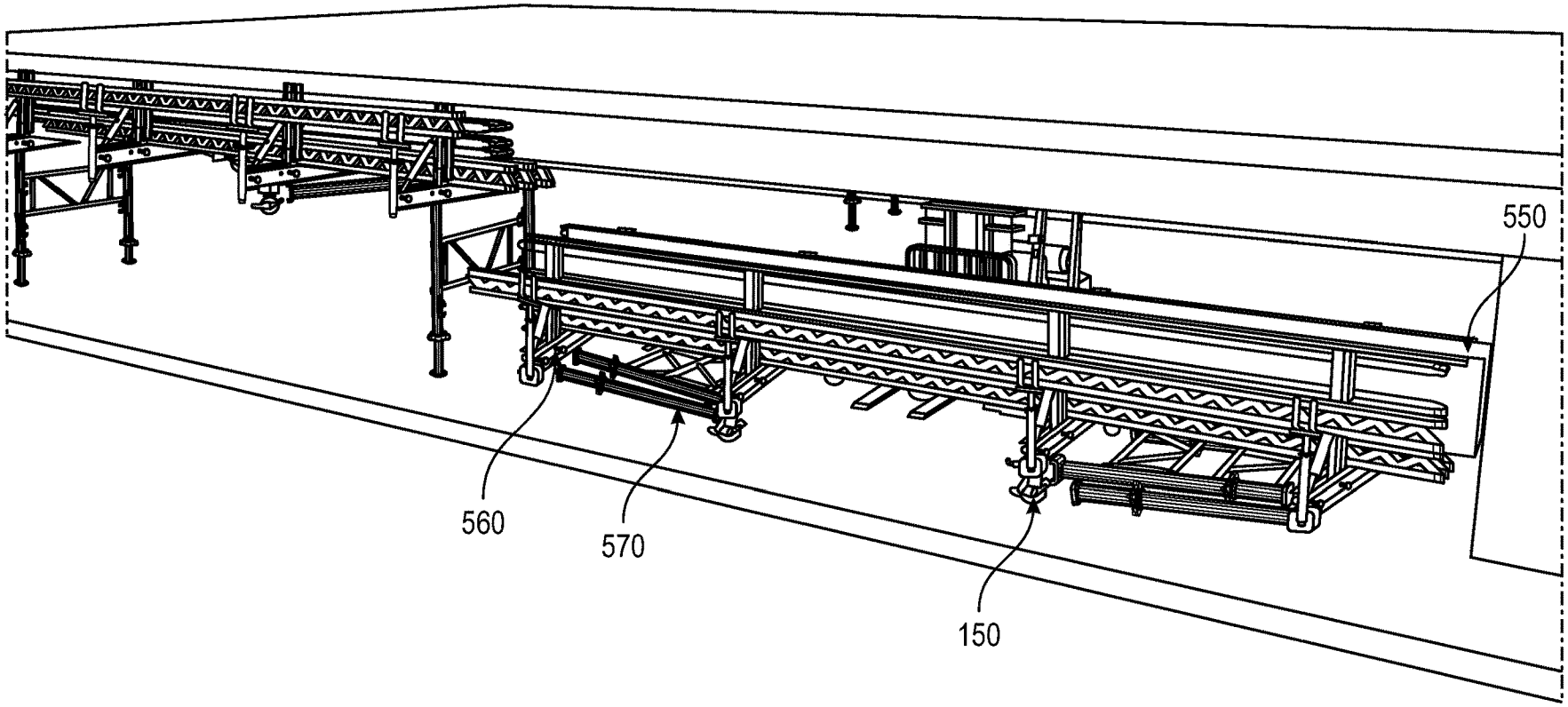
FIG. 11 depicts the beam table, waler, and shoring lowered from the slab table during a method of assembly and/or disassembly of one or more walers from a concrete slab.

FIG. 11 depicts the beam table 550, waler 560, and shoring 570 lowered from the slab table 570. This can be accomplished by arranging a forklift 540 beneath the beam table 550 and lowering the beam table 550, waler 560, and shoring 570 (e.g., beam assembly) to the slab 510 and allowing the assembly to rest on castor wheels 150. Once there, the assembly can be rolled to a new position for assembly/pouring of an additional level or section of the concrete structure. This is referred to as cycling, e.g., assembling the beam table, waler, shoring assembly, pouring concrete, stripping the assembly, moving the assembly to a new location, and beginning the assembling process again. Advantageously, the castor wheels of the present application need not be removed before, during, or after the cycling process, and in particular, during the folding step. This eliminates the number of steps during a cycle and provides a more efficient cycling process.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. As used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the terms "about" and/or "substantially" and/or "approximately" are employed with respect to a given measurement, value, or characteristic, it refers to a quantity that is within a normal operating range to achieve desired results, but that includes some variability due to inherent inaccuracy and error within the allowed tolerances of the system (e.g. 1-5 percent). It can also refer to variability or rounding errors associated with conversion of measurements or values from one unit to another (e.g., Imperial to metric or vice versa). Accordingly, this description is meant to be taken only by way of example, and not to otherwise limit the scope of this invention.

What is claimed is:

1. A waler, comprising:

a longitudinally extending beam comprising a pair of flanges;

a pair of vertical support tubes disposed at opposing ends of the beam, the pair of vertical support tubes are formed of a steel having a greater strength than a steel forming the longitudinally extending beam;

at least one castor attachment interface integrally formed with the longitudinally extending beam configured to removably receive one or more castor wheels.

2. The waler of claim 1, further comprising:

a hinge plate engaged with a bottom surface of the beam.

3. The waler of claim 2, wherein the hinge plate is configured to engage with a shoring assembly and the hinge plate is further configured to fold the shoring toward the waler.

4. The waler of claim 1, wherein the pair of vertical support tubes are made from a steel having an ASTM A500 standard.

5. The waler of claim 1, wherein the longitudinally extending beam is made from a steal having an A36 standard.

6. The waler of claim 1, wherein the pair of vertical support tubes define a tensile strength of at least 46 ksi.

7. The waler of claim 1, wherein the longitudinally extending beam has a height in the range of 6 to 8 inches.

8. The waler of claim 1, wherein a ratio of length of the longitudinally extending beam to a height of the pair of vertical support tubes is about 12:1.

9. The waler of claim 1, wherein the pair of vertical support tubes are configured to support up to 70 kN of load.

10. A waler, comprising:

a longitudinally extending beam comprising a pair of flanges;

a pair of vertical support tubes disposed at opposing ends of the beam, the pair of support tubes being about 14 inches in height and extending about 6 inches above a top surface of the longitudinally extending beam, wherein the pair of vertical support tubes are formed of a steel having a greater strength than a steel forming the longitudinally extending beam; and at least one castor attachment interface.

11. The waler of claim 10, further comprising:

a hinge plate engaged with a bottom surface of the beam.

12. The waler of claim 11, wherein the hinge plate is configured to engage with a shoring assembly and the hinge plate is further configured to fold the shoring toward the waler.

13. The waler of claim 10, wherein the longitudinally extending beam has a height in the range of 6 to 8 inches.

14. The waler of claim 10, wherein a ratio of length of the longitudinally extending beam to a height of the pair of vertical support tubes is about 12:1.

15. The waler of claim 10, wherein the pair of vertical support tubes are configured to support up to 70 kN of load.

16. A method of stripping a waler from concrete, comprising:

attaching a castor wheel to a castor attachment interface integrally formed with a waler;

removing a pin from a hinge plate, the hinge plate engaged with a lower surface of the waler and positioned above the attached caster wheel;

folding at least one shoring upwardly toward the waler, without removing the castor wheel from the castor attachment interface, via the hinge plate engaged with the lower surface of the waler;

transporting the waler via the at least one castor wheel.

17. The method of claim 16, wherein the at least one shoring is folded in a direction transverse to a longitudinal axis of the wheel.

* * * * *